US009157403B2

(12) United States Patent
Saito et al.

(10) Patent No.: US 9,157,403 B2
(45) Date of Patent: Oct. 13, 2015

(54) FUEL INJECTION VALVE

(75) Inventors: Takahiro Saito, Isesaki (JP); Nobuaki Kobayashi, Maebashi (JP); Hiroshi Ohno, Honjyo (JP); Atsushi Nakai, Isesaki (JP); Yoshio Okamoto, Omitama (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 764 days.

(21) Appl. No.: 13/432,438

(22) Filed: Mar. 28, 2012

(65) Prior Publication Data

US 2012/0247427 A1 Oct. 4, 2012

(30) Foreign Application Priority Data

Apr. 1, 2011 (JP) ..... 2011-081383

(51) Int. Cl.
*F02M 61/18* (2006.01)
*F02M 61/06* (2006.01)
*F02M 61/16* (2006.01)

(52) U.S. Cl.
CPC ..... *F02M 61/162* (2013.01); *F02M 61/1806* (2013.01); *F02M 61/1846* (2013.01); *F02M 61/1853* (2013.01); *F02M 61/1886* (2013.01)

(58) Field of Classification Search
CPC .. B05B 1/34; F02M 61/1846; F02M 61/1853; F02M 16/1886; F02M 61/18; F02M 61/10; F02M 51/06
USPC ..... 239/533.14, 596, 533.2, 533.3, 533.12, 239/533.1, 461, 463, 518, 504
See application file for complete search history.

(56) References Cited

U.S. PATENT DOCUMENTS

| | | | | |
|---|---|---|---|---|
| 3,680,793 | A * | 8/1972 | Tate et al. | 239/468 |
| 6,513,724 | B1 * | 2/2003 | Joseph et al. | 239/5 |
| 6,708,907 | B2 * | 3/2004 | Fochtman et al. | 239/585.1 |
| 6,783,085 | B2 * | 8/2004 | Xu | 239/463 |
| 6,854,670 | B2 * | 2/2005 | Sumisha et al. | 239/543 |
| 7,434,752 | B2 * | 10/2008 | Matsumoto et al. | 239/585.4 |
| 8,567,701 | B2 * | 10/2013 | Hashii et al. | 239/601 |

FOREIGN PATENT DOCUMENTS

JP 2003-336561 A 11/2003

* cited by examiner

*Primary Examiner* — Justin Jonaitis
(74) *Attorney, Agent, or Firm* — Foley & Lardner LLP

(57) ABSTRACT

A fuel injection valve includes a valve element movably disposed to a valve seat member having a valve seat and formed with an opening located at a downstream side thereof. A swirl imparting chamber is formed to impart a swirl force to fuel within the swirl imparting chamber by turning fuel. An injection hole is opened to the bottom of swirl imparting chamber to inject fuel to outside. Additionally, a communication passage is formed to connect the swirl imparting chamber with the opening of the valve seat member. In this fuel injection valve, the swirl imparting chamber and the communication passage are formed to satisfy the following equation:

$$0.15 \leq W/D < 0.5$$

where W is width of the communication passage; and D is diameter of the swirl imparting chamber.

21 Claims, 9 Drawing Sheets

FUEL INJECTION VALVE

BACKGROUND OF THE INVENTION

This invention relates to a fuel injection valve used for fuel injection in an engine.

As a technique of this kind, Japanese Patent Provisional Publication No. 2003-336561 discloses a fuel injection valve in which a passage plate and an injector plate are welded to a valve seat member. The passage plate is formed with a side hole, a lateral passage and a swirl chamber, and the injector plate is formed with a fuel injection hole.

SUMMARY OF THE INVENTION

However, with the above technique described in the publication, fuel injection characteristics of fuel to be injected from the fuel injection hole largely changes if the shapes of the lateral passage, the swirl chamber and the fuel injection hole are changed.

In view of the above problems, the present invention has been made and has an object to provide a fuel injection valve which can stabilize change in fuel injection characteristics of fuel to be injected from the fuel injection opening.

An aspect of the present invention resides in a fuel injection valve comprising a movable valve element. A valve seat member is provided having a valve seat on which the valve element is seated to establish a valve closing condition. The valve seat member is formed with an opening located at a downstream side of the valve seat member. A first section is provided to define a swirl imparting chamber for imparting a swirl force to fuel within the swirl imparting chamber by turning fuel. A second section is provided to define an injection hole opened to bottom of swirl imparting chamber to inject fuel to outside. Additionally, a third section is provided to define a communication passage for connecting the swirl imparting chamber with the opening of the valve seat member. In this fuel injection valve, the swirl imparting chamber and the communication passage are formed to satisfy the following equation:

$$0.15 \leq W/D < 0.5$$

where W is width of the communication passage; and D is diameter of the swirl imparting chamber.

Another aspect of the present invention resides in a fuel injection valve comprising a generally cup-shaped valve seat member having a valve seat and formed with an opening located at a downstream side of the valve seat member. A generally spherical valve element is movably disposed to the valve seat member and seated on the valve seat of the valve seat member to establish a valve closing condition. A generally disc-shaped nozzle plate is coaxially disposed to the valve seat member and formed with a plurality of injection holes through which fuel is injected to outside. Additionally, a section is provided to define a plurality of swirl imparting chambers for imparting a swirl force to fuel within the swirl imparting chamber by turning fuel, and a plurality of communication passages each of which connects each swirl imparting chamber with the opening of the valve seat member, each swirl imparting chamber being connected to each injection hole of the nozzle plate, each communication passage having a first end tangentially connected to each swirl imparting chamber, the communication passages having respective second ends which are connected to each other to form a chamber which is connected to the opening of the valve seat member. In this fuel injection valve, each swirl imparting chamber and each communication passage are formed to satisfy the following equation:

$$0.15 \leq W/D < 0.5$$

where W is width of each communication passage; and D is diameter of each swirl imparting chamber.

The other objects and features of this invention will become understood from the following description with reference to the accompanying drawings.

BRIEF DESCRIPTION OF THE DRAWINGS

In the drawings, like reference numerals designate like parts and elements throughout all figures, in which.

DETAILED DESCRIPTION OF THE INVENTION

Figure 1:
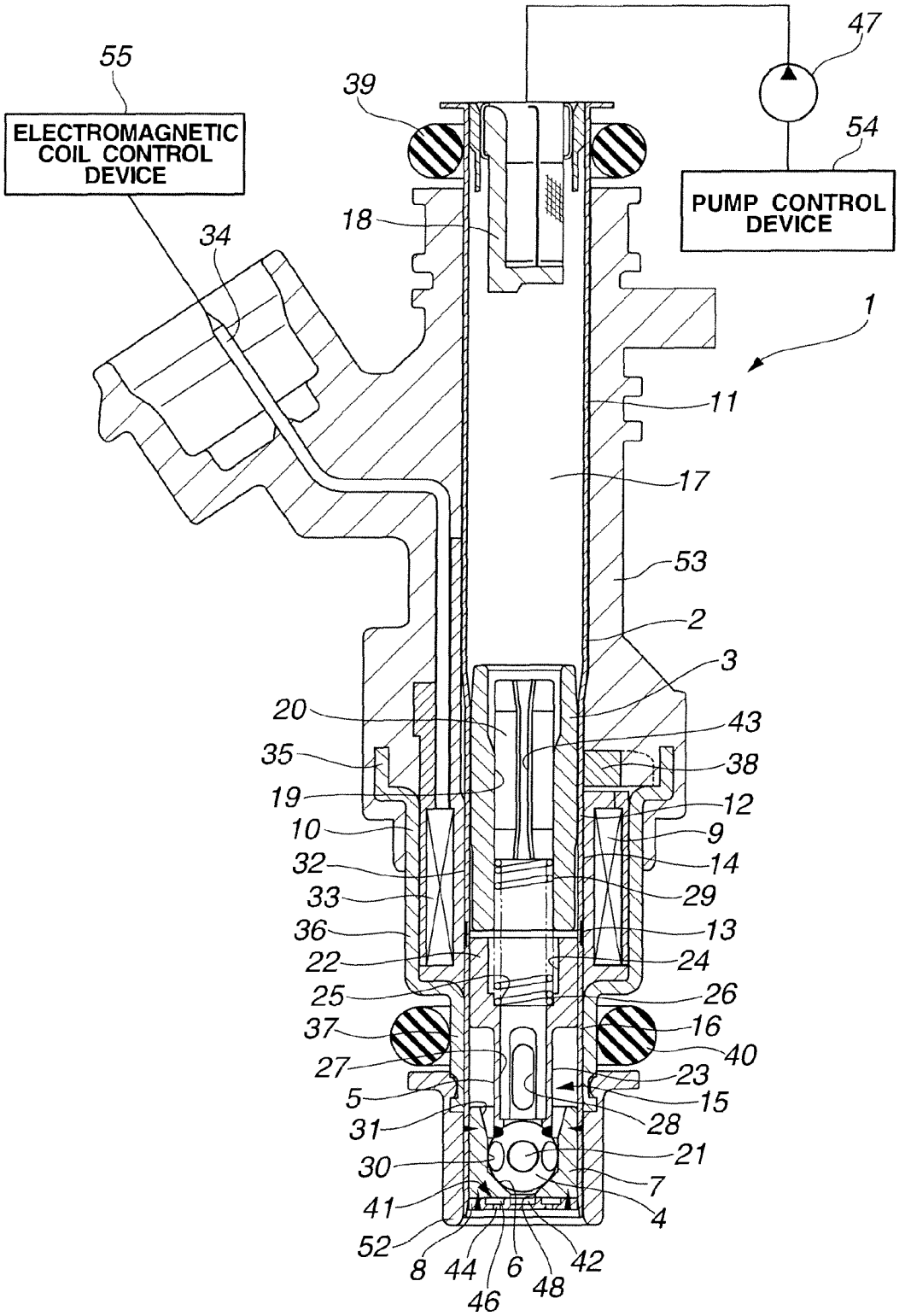
FIG. 1 is an axial sectional view of a first embodiment of a fuel injection valve according to the present invention.
Figure 2:
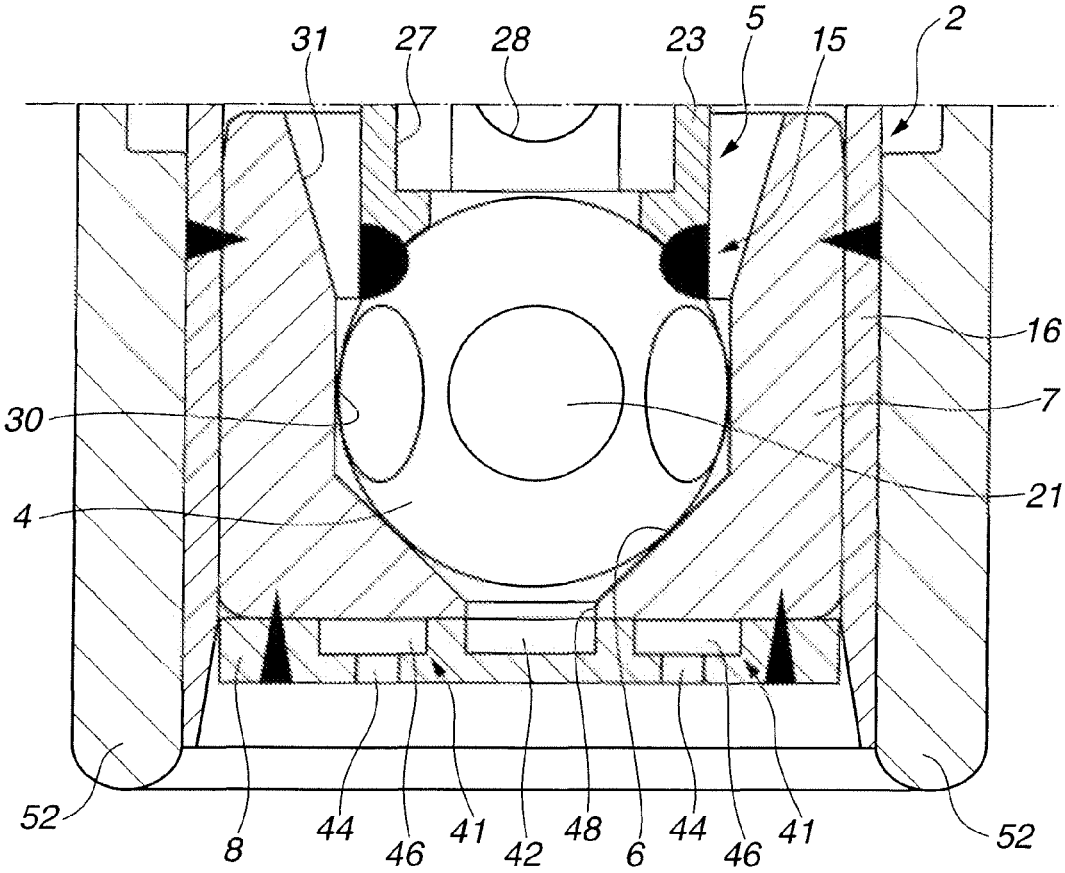
FIG. 2 is an enlarged fragmentary axial sectional view of a section around a nozzle plate, of the first embodiment of the fuel injection valve.
Figure 3:
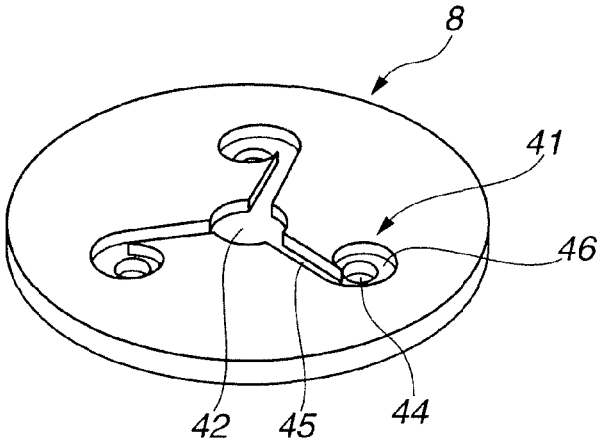
FIG. 3 is a perspective view of the nozzle plate used in the first embodiment of fuel injection nozzle as an example of the nozzle plate.

Referring now to FIGS. 1 to 3 of drawings, a first embodiment of a fuel injection valve according to the present invention is illustrated by the reference numeral 1. FIG. 1 is an axial sectional view of fuel injection valve 1. This fuel injection valve 1 is to be used in an automotive gasoline-fueled internal combustion engine and configured to inject fuel into an intake manifold so that it is a so-called low pressure type fuel injection valve.

Fuel injection valve 1 includes a magnetic cylinder 2. A core cylinder 3 is accommodated inside the magnetic cylinder 2. A valve element 4 is axially movably disposed inside the magnetic cylinder 2. A valve shaft 5 is formed integral with valve section 4. A valve seat member 7 has a valve seat 6 on which valve element 4 is seated to establish a valve closing condition during closing of fuel injection valve 1. A nozzle plate 8 is formed with fuel injection holes 44 through which fuel is injected during opening of fuel injection valve 1. An electromagnetic coil 9 is provided to cause valve element 4 to slidably move in a valve opening direction (where valve element 4 separates from valve seat 6) when energized. A yoke 10 is provided to induce lines of magnetic flux.

Magnetic cylinder 2 is formed of a metallic pipe or the like made of a magnetic metal material such as electromagnetic stainless steel or the like. Magnetic cylinder 2 is formed as a one-piece member and formed into the shape of a cylinder having large and small diameter sections 11, 12 which are connected to each other through a frustoconical section as shown in FIG. 1, by using means of press working such as deep drawing, grinding or the like. Large diameter section 11 is disposed at an upper end side of fuel injection valve 1 while small diameter section 12 is disposed at a lower end side of fuel injection valve and has a diameter smaller than large diameter section 11.

Small diameter section 12 is formed with an annular thin-wall portion 13 which is formed by partly thinning the wall of small diameter section 12. Small diameter section 12 includes a core cylinder accommodating portion 14 and a valve section accommodating portion 16 which are bounded by thin-wall portion 13. The core cylinder accommodating portion 14 is located at the upper end side of fuel injection valve 1 relative to the thin-wall portion 13 to accommodate core cylinder 3, whereas valve section accommodating portion 16 is located at the lower end side of fuel injection valve 1 relative to thin-wall portion 13 to accommodate valve section 15 including valve element 4, valve shaft 5 and valve seat member 7. Thin-wall portion 13 is formed surrounding a clearance formed between core cylinder 3 and valve shaft 5 in a condition where core cylinder 3 and valve shaft 5 are accommodated inside the magnetic cylinder 2. Thin-wall portion 13 increases a magnetic resistance between core cylinder accommodating section 14 and valve section accommodating section 16 so as to make a magnetic interruption between core cylinder accommodating section 14 and valve section accommodating section 16.

The inner peripheral surface of large diameter section 11 defines a fuel passage 17 through which fuel is fed to valve section 15. An upper end section of large diameter section 11 is provided with a fuel filter 18 for filtering fuel. A pump 47 is connected to fuel passage 17 and controlled by a pump control device 54.

Core cylinder 3 is formed into the shape of a cylinder having a hollow section 19 and press-fitted in core cylinder accommodating section 14 of magnetic cylinder 2. A spring receiver 20 is accommodated in hollow section 19 and fixed in position by means of press-fitting or the like. This spring receiver 20 is formed at its central portion with a fuel passage 43 which axially pierces the wall of the spring receiver.

Valve element 4 is formed generally spherical in outer shape, and formed at its outer surface with fuel passage faces 21 which are parallel with an imaginary vertical plane extending in the axial direction of fuel injection valve. Fuel passage faces 21 are formed by grinding the generally spherical outer surface of valve element 4. Valve shaft 5 includes a large diameter section 22 and a small diameter section 23 whose outer diameter is smaller than that of large diameter section 22.

Valve element 4 is fixed to the tip end section of small diameter section 23 to form an one-piece body by welding. It is to be noted that dark semicircles and dark triangles indicate locations of welding. Large diameter section 22 is formed at its end section with a spring insertion hole 24. A spring seat portion 25 is coaxially formed at the bottom of spring insertion hole 24 and has a diameter smaller than that of large diameter section 22. Additionally, a step-like portion or spring receiving portion 26 is also coaxially formed at the bottom of spring insertion hole 24. Small diameter section 23 is formed at its end portion with a fuel passage hole 27 which is in communication with spring insertion hole 24. A fuel outflow opening 28 is formed piercing through the wall of small diameter section 23 to establish communication between the outer peripheral side of small diameter section 23 and fuel passage hole 27.

Valve seat member 7 has generally frustoconical valve seat 6. Valve seat 6 is integrally connected to a cylindrical wall surface defining a valve element support hole 30. Valve element support hole 30 has an inner diameter which is generally equal to the diameter of valve element 4. An upstream opening section 31 is formed connecting with valve element support hole 30 and defined by a generally frustoconical wall surface whose diameter increases in a direction toward the upper end side of valve seat member 7. A downstream opening 48 is formed at the central and lower end portion of valve seat member 7 and opened to the outside of the valve seat member.

Valve shaft 5 and valve element 4 are axially slidably disposed inside the magnetic cylinder 2. A coil spring 29 is disposed between spring receiving portion 26 and spring receiver 20 to bias valve shaft 5 and valve element 4 toward the lower end side of valve seat member 7. Valve seat member 7 is inserted in magnetic cylinder 2 and fixed to magnetic cylinder 2 by welding. Valve seat 6 is formed in such a manner as to decrease in diameter in a direction toward downstream opening 48 so that valve element 4 is seated on valve seat 6 during closing of fuel injection valve 1. The valve seat 6 has a generally frustoconical surface which has an angle of 45 degrees in an imaginary vertical plane containing the axis of valve seat member 7.

Electromagnetic coil 9 is disposed around the outer peripheral surface of the magnetic cylinder 2 disposed on core cylinder 3. In other words, electromagnetic coil 9 is disposed around the outer peripheral surface of core cylinder 3. Electromagnetic coil 9 includes a bobbin 32 formed of a resinous material or plastic, and a coil 33 wound on this bobbin 32. Coil 33 is electrically connected through a connector pin 34 to an electromagnetic coil control device 55.

Electromagnetic coil control device 55 is configured to allow current to flow through a coil 33 of electromagnetic coil 9 at a timing of injecting fuel to a combustion chamber side of the engine which timing is calculated based on information from a crank angle sensor for detecting a crank angle of the engine, thereby opening fuel injection valve 1.

Yoke 10 is formed hollow so as to have a vertical piercing hole extending from the lower end to the upper end of the yoke. Yoke 10 includes a large diameter section 35 formed at the side of the upper end of the yoke, a small diameter section 37 formed at the side of the lower end of the yoke, and an intermediate-diameter section 36 which is located between large diameter section 35 and the small diameter section 37 and has a diameter smaller than that of large diameter section 37 and larger than that of small diameter section 37. Small diameter section 37 is fittingly disposed on the outer peripheral surface of the valve section accommodating section 16. Electromagnetic coil 9 is accommodated inside the inner peripheral surface of intermediate-diameter section 36. A connecting core 38 is disposed inside the inner peripheral surface of large diameter section 35.

Connecting core 38 is formed of a magnetic metal material or the like and formed generally C-shaped. Yoke 10 is connected to magnetic cylinder 2 at its small diameter section 37 and at its large diameter section 35 and through the connecting core 38. In other words, yoke 10 is electromagnetically connected at its opposite end sections with magnetic cylinder 2. An O-ring 40 for fitting fuel injection valve 1 to an intake port of the engine is held on the lower end-side tip end section of yoke 10. Additionally, a protector 52 is installed on the lower end section of magnetic cylinder 2 for the purpose of protection of the tip end portion of magnetic cylinder 2.

When current is supplied to electromagnetic coil 9 through connector pin 34, a magnetic field is generated. A magnetic force of this magnetic field moves valve element 4 and valve shaft 5 against the biasing force of coil spring 29 so as to separate valve element 4 from valve seat 6, thus to open fuel injection valve 1.

As shown in FIG. 1 for fuel injection valve 1, almost all parts of fuel injection valve 1 are covered with a plastic cover 53. The parts covered with plastic cover 53 include a part extending from a position (of magnetic cylinder 2) slightly lower than the upper end of large diameter section 11 to a position (of magnetic cylinder 2) at which electromagnetic coil 9 is disposed on small diameter section 12, a part between electromagnetic coil 9 and intermediate-diameter section 36 of yoke 10, a part between the outer peripheral surface of connecting core 38 and large diameter section 35 of yoke 10, an outer peripheral portion of large diameter section 35 of yoke 10, an outer peripheral portion of intermediate-diameter section 36 of yoke 10, and an outer peripheral portion of connector pin 34. The tip end portion of connector pin 34 is located in a hollow formed inside a generally cup-shaped section of plastic cover 53, so that a connector of electromagnetic coil control device or control unit 55 is to be inserted in the cup-shaped section, though not shown.

An O-ring 39 is fittingly disposed on the outer peripheral surface of the upper end section of magnetic cylinder 2, while O-ring 40 is fittingly disposed on the outer peripheral surface of small diameter section 37 of yoke 10.

Nozzle plate 8 is welded to the lower end of valve seat member 7. Nozzle plate 8 is formed with a plurality of swirl chambers 41 for imparting swirl (spiral flow) to fuel, a central chamber 42 for distributing fuel to the respective swirl chambers, and fuel injection holes 44 through which swirl-imparted fuel in the respective swirl chambers are injected. Central chamber 42 is connected with downstream opening 48 of valve seat member 7.

[Configuration of Nozzle Plate]

FIG. 2 is an enlarged sectional view of a section around nozzle plate 8 of fuel injection valve 1. FIG. 3 is a perspective view of nozzle plate 8. A configuration of nozzle plate 3 will be discussed with reference to FIGS. 2 and 3.

Nozzle plate 8 is disc-shaped and formed at its upper side surface with swirl chambers 41 and central chamber 42. Central chamber 42 is formed at the central part of nozzle plate 8 and formed as a circular depression or bottomed hole. Nozzle plate 8 is formed with three swirl chambers 41 each of which includes a communication passage 45 and a swirl imparting chamber 46. Communication passages 45 are connected with each other at the central section (or connection section) of nozzle plate 8. Central chamber 42 is formed at the nozzle plate central section at which communication passages 45 are connected with each other. Swirl imparting chamber 46 is formed at an end of each communication passage 45, in which communication passage 45 is tangentially connected to swirl imparting chamber 46 in plan or on a plane perpendicular to the axis of nozzle plate 8. Swirl imparting chamber 46 is formed as a depression or a bottomed hole and therefore has an inner side wall **46*a* and a bottom wall 46*b* having a spiral surface. Thus, swirl imparting chamber 46 is spirally formed as a whole, or has a spirally configured bottom section. A fuel injection hole 44 is formed at the bottom wall and extends to the lower side so as to be communicated with the inside of the swirl imparting chamber 46**.

[Detail of Swirl Chamber and Fuel Injection Hole]

Figure 4:
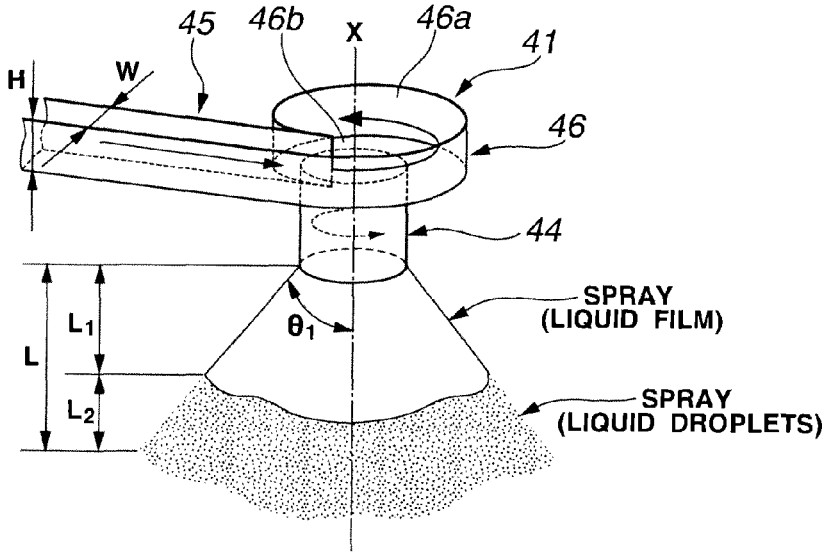
FIG. 4 is a schematic perspective illustration of a communication passage, a swirl imparting chamber and a fuel injection hole in the first embodiment of the fuel injection valve.
Figure 5:
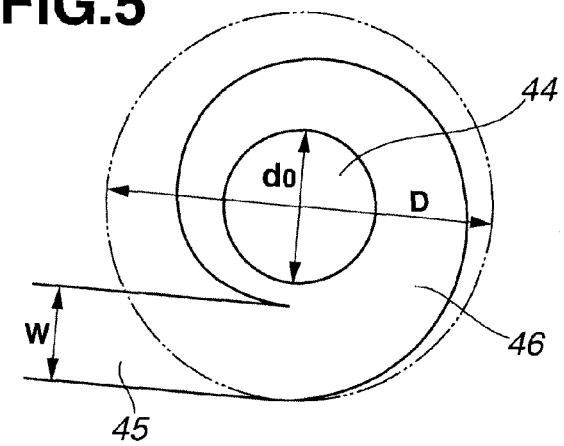
FIG. 5 is a schematic plan view showing the swirl imparting chamber and the fuel injection hole in the first embodiment of the fuel injection valve.

FIG. 4 is a perspective view of swirl chamber 41 and fuel injection hole 44. FIG. 5 is a plan view of swirl chamber 41 and fuel injection hole 44.

As shown in FIG. 4, W and H represent respectively a width and a height of communication passage 45. Communication passage 45 has a rectangular cross-section on an imaginary plane perpendicular to axis of the communication passage. As shown in FIG. 5, D represents a diameter of swirl imparting chamber 46, and d0 represents a diameter of fuel injection hole 44. It is to be noted that the swirl imparting chamber diameter D is a diameter of a circle which is formed based on a curvature of inner side wall **46*a* at a part (where communication passage 45 is connected to swirl imparting chamber 46) of swirl imparting chamber 46 in plan or on a plane perpendicular to the axis of nozzle plate 8**.

Additionally, da represents a flow equivalent diameter of communication passage 45. It is general that fuel cannot uniformly flow inside communication passage 45 so that a flow rate of fuel is small in the vicinity of an inner wall of communication passage 45 as compared with that at a central portion of the communication passage. Flow equivalent diameter da is a diameter of a duct which is assumed such that fuel uniformly flows at a flow rate in communication passage 45, and therefore the flow equivalent diameter can be obtained by the following equation:

$$da=\sqrt{4WH/\pi}$$

Additionally, swirl chamber 41 and fuel injection hole 44 are formed to satisfy the following four equations:

$H/D \geq 0.15$ $0.15 \leq W/D < 0.5$ $0.6 \leq W/H \leq 1.6$ $da/d0 \geq 0.5$

[Operation]

<Flow of Fuel During Closing of Fuel Injection Valve>

When current is not passed through coil 33 of electromagnetic coil 9, valve shaft 5 is biased toward the lower end side of fuel injection valve under the biasing force of coil spring 29 so that valve element 4 is seated on valve seat 6. As a result, blocking is made between valve element 4 and valve seat 6 thereby preventing fuel from being supplied to the side of nozzle plate 8.

<Flow of Fuel During Opening of Fuel Injection Valve>

Flow of fuel during opening of fuel injection valve 1 will be discussed with reference to FIG. 4.

When current is passed through coil 33 of electromagnetic coil 9, valve shaft 5 is drawn up toward the upper end side of fuel injection valve 1 against the biasing force of coil spring 29 under the action of an electromagnetic force. As a result, valve element 4 is separated from valve seat 6 so that fuel is supplied to the side of nozzle plate 8.

Fuel supplied to nozzle plate 8 first enters central chamber 42 and strikes against the bottom surface of the central chamber 42 so that fuel flow is changed from its axial flow to its radial flow to be flown into respective communication passages 45. Since each communication passage 45 is tangentially connected to swirl imparting chamber 46, fuel passed through communication passage 45 turns or circles around along the inner side wall 46*a* of swirl imparting chamber 46.

Thus, a swirl force is imparted to fuel in swirl imparting chamber 46, so that fuel having the swirl force is injected upon being turned along the cylindrical side wall of fuel injection hole 44. As a result, fuel injected from fuel injection hole 44 is scattered in a tangential direction of fuel injection hole 44 as fuel spray. The fuel spray immediately after being injected from fuel injection hole 44 conically spreads in a thin liquid film state under the action of a circular edge portion defining an open end of fuel injection hole 44. Then, fuel in the liquid film state is divided to form atomized liquid droplets.

This can promote vaporization of fuel to improve a combustion efficiency, thereby making it possible to reduce production of nitrogen oxides or the like during an engine starting at a low temperature.

Here, as shown in FIG. 4, L represents an injection distance of fuel; L1 represents the distance of a range in which fuel is in the liquid film state, in the injection distance L; and L2 represents the distance of a range in which fuel in the liquid film state is divided into the state of liquid droplets. Additionally, θ1 represents a spread angle between an outer surface of the spread fuel and an axis X of fuel injection hole 44 on an imaginary plane containing the axis X.

<Stabilization of Fuel Injection Characteristics>

Discussion will be made on change in film thickness, flow velocity and flow rate of fuel injected through fuel injection hole 44 according to change in shape of swirl chamber 41 and fuel injection hole 44, with reference to FIGS. 6 to 9.

Figure 6:
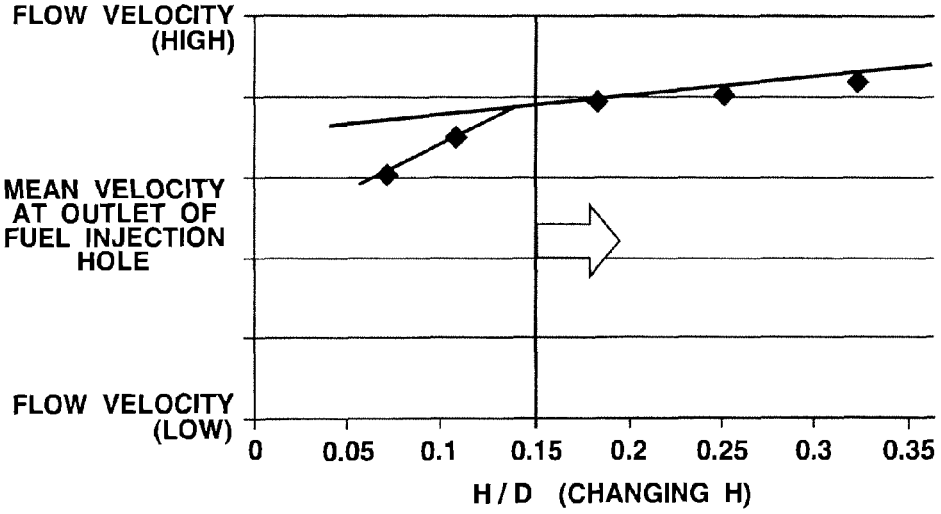
FIG. 6 is a graph showing change in fuel injection characteristics of the first embodiment of the fuel injection valve in terms of H/D.

FIG. 6 is a graph showing a mean flow velocity of fuel at the outlet of fuel injection hole 44 according to change in ratio (hereinafter referred to as H/D) of a height H of communication passage 45 to diameter D of swirl imparting chamber 46. In FIG. 6, numerical values obtained by changing height H of communication passage 45 upon fixing width W of communication passage 45, diameter D of swirl imparting chamber 46 and diameter d0 of fuel injection hole 44 are plotted.

Figure 7:
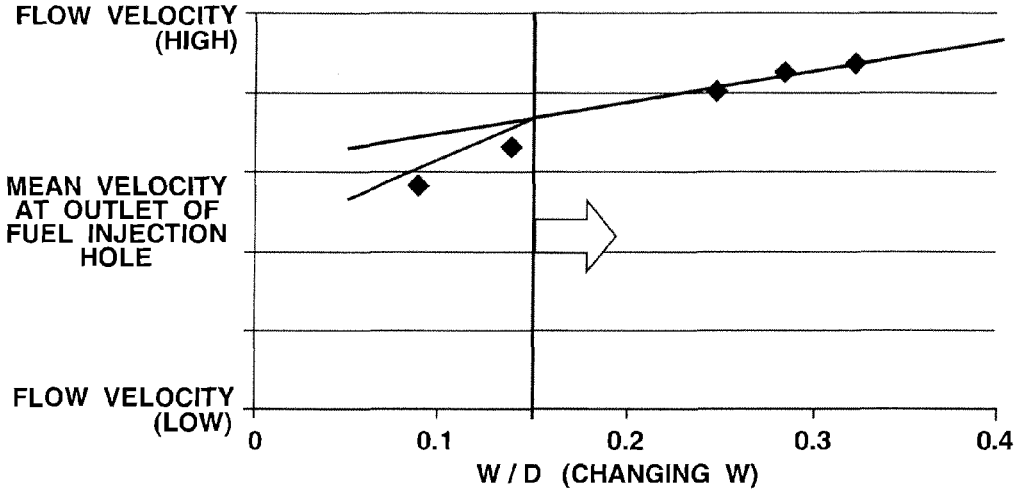
FIG. 7 is a graph showing change in fuel injection characteristics of the first embodiment of the fuel injection valve in terms of W/D.

FIG. 7 is a graph showing a mean flow velocity of fuel at the outlet of fuel injection hole 44 according to change in ratio (hereinafter referred to as W/D) of width W of communication passage 45 to diameter D of swirl imparting chamber 46. In FIG. 7, numerical values obtained by changing width W of communication passage 45 upon fixing height H of communication passage 45, diameter D of swirl imparting chamber 46 and diameter d0 of fuel injection opening 44.

Figure 8:
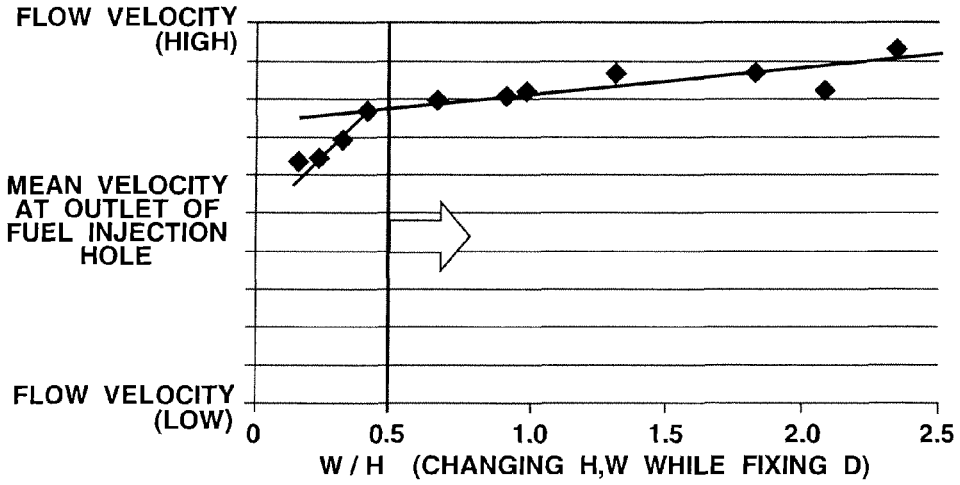
FIG. 8 is a graph showing change in fuel injection characteristics of the first embodiment of the fuel injection valve in terms of W/H.

FIG. 8 is a graph showing a mean flow velocity of fuel at the outlet of fuel injection hole 44 according to change in ratio (hereinafter referred to as W/H) of width W to height H of communication passage 45. In FIG. 8, numerical values obtained by changing height H and width W of communication passage 45 and by making constant a product (sectional area) of height H and width W of communication passage 45 so that a flow ratio becomes around 100% upon fixing diameter D of swirl imparting chamber 46 are plotted.

Figure 9:
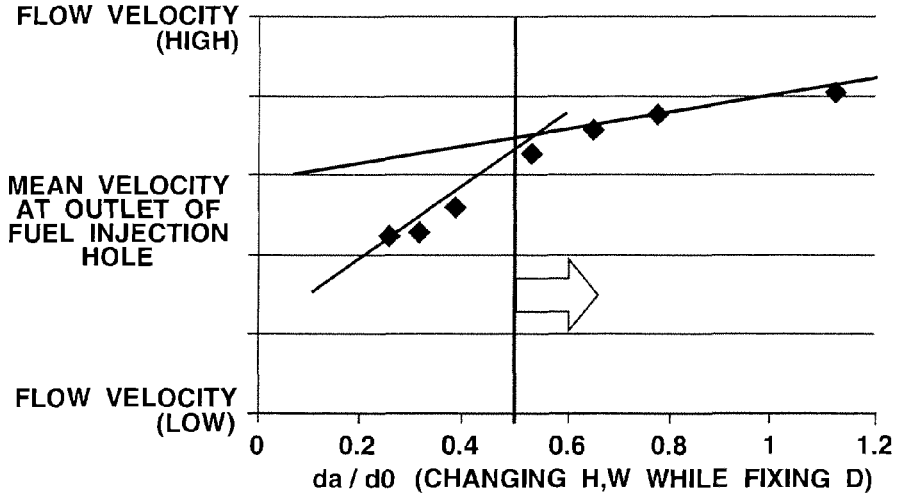
FIG. 9 is a graph showing change in fuel injection characteristics of the first embodiment of the fuel injection valve in terms of da/d0.

FIG. 9 is a graph showing a mean flow velocity at the outlet of fuel injection hole 44 according to change in ratio (hereinafter referred to as da/d0) of flow equivalent diameter da of communication passage 45 to diameter d0 of fuel injection hole 44. In FIG. 9, numerical values obtained by changing height H and width W of communication passage 45 in a condition where H and W are maintained in an equivalent relationship upon fixing diameter d0 of fuel injection hole 44.

The mean flow velocity in FIGS. 6 to 9 is determined by a simulation upon setting width W and height H of communication passage 45, diameter D of swirl imparting chamber 46, flow equivalent diameter da of communication passage 45, and diameter d0 of fuel injection hole 44.

For example, on the basis of the relationship of H/D, the mean flow velocity in a range of less than 0.15 is large in change as compared with that in a range of not less than 0.15 as shown in FIG. 6.

If swirl chamber 41 or fuel injection hole 44 is designed in a range extending across a point at which a variation of mean flow velocity characteristics changes (for example, in a range extending across H/D=0.15), change in fuel injection characteristics is not constant to change in shape so that determination of the specification becomes difficult. Additionally, each product of fuel injection valve 1 shows a dispersion due to production error. Therefore, if swirl chamber 41 or fuel injection hole 44 is designed in a range where variation in fuel injection characteristics is large, error of the fuel injection characteristics becomes large. Here, the fuel injection characteristics represents a fuel particle diameter and a fuel injection directivity and more specifically represents a fuel injection angle θ1, injection distance L of fuel, liquid film state range distance L1 and liquid droplets state range distance L2.

Accordingly, it is desirable that the swirl chamber 41 or fuel injection hole 44 is formed within a range where a variation characteristics of fuel injection characteristics does not change and within a range where a variation of fuel injection characteristics is small. If such a fuel injection characteristics is inspected from FIGS. 6 to 9, it will be understood that variation of the fuel injection characteristics is stable within a range where H/D is not less than 0.15; W/D is not less than 0.15; W/H is not less than 0.5; and da/d0 is not less than 0.5.

Figure 10:
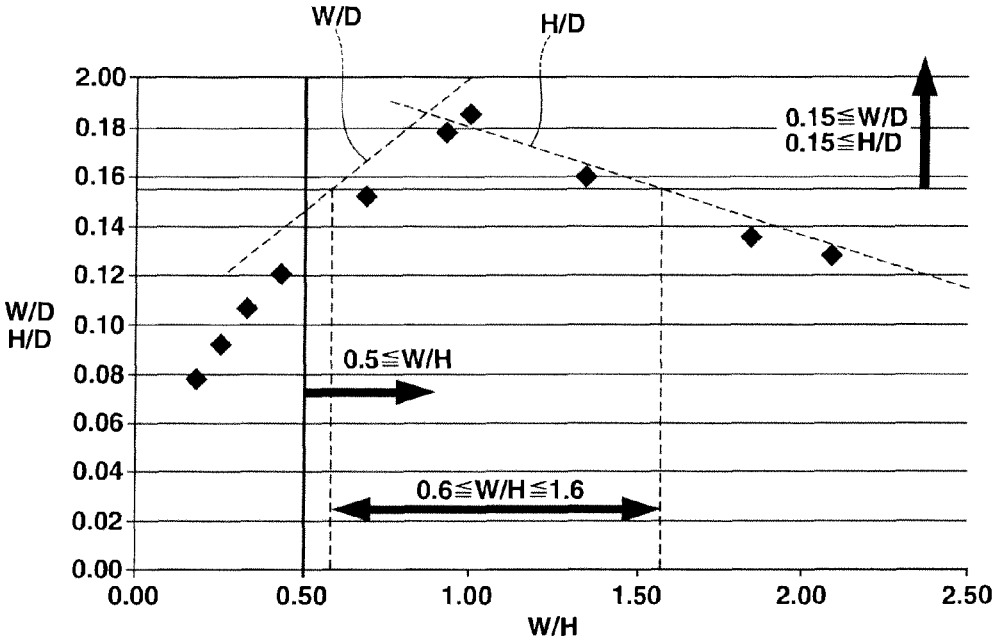
FIG. 10 is a graph showing the relationship of W/D and H/D relative to W/H in the first embodiment of the fuel injection valve.

FIG. 10 is a graph formed by plotting values of W/D and H/D (on the axis of ordinate) corresponding to W/H (on the axis of abscissa) using the data of width W and height H of communication passage 45 and diameter D of swirl imparting chamber 46 used when the graph of FIG. 8 relating to W/H is produced. If a range (H/D is not less than 0.15, and W/D is not less than 0.15) where variation of the fuel injection characteristics becomes stable is specified from FIG. 10, W/H is within a range of from not less than 0.6 to not larger than 1.6.

Additionally, concerning W/D if width W of communication passage 45 is longer than ½ of diameter D of swirl imparting chamber 46, fuel may not sufficiently turn within the swirl imparting chamber 46. Therefore, it is desirable to set W/D at a value of less than 0.5.

By forming swirl chamber 41 and fuel injection hole 44 in such a manner as to satisfy the following four equations based on the above inspection, swirl chamber 41 and fuel injection hole 44 can fall within a range where the variation characteristics of the fuel injection characteristics does not change and within a range where the variation of the fuel injection characteristics is small:

$$H/D \geq 0.15$$

$$0.15 \leq W/D < 0.5$$

$$0.6 \leq W/H \leq 1.6$$

$$da/d0 \geq 0.5$$

By this, variation of the fuel injection characteristics becomes constant relative to change in shape of swirl chamber 41 and fuel injection hole 44, and therefore decision of the specification for fuel injection valve 1 can be easily made. Additionally, variation of the fuel injection characteristics due to production error of swirl chamber 41 and fuel injection hole 44 is small, and therefore error of the fuel injection characteristics can be minimized.

[Effects]

Effects of the first embodiment of the fuel injection valve 1 according to the present invention will be enumerated below.

(1) The fuel injection valve 1 comprises: a movable valve element 4; a valve seat member 7 having a valve seat 6 on which the valve element 4 is seated to establish a valve closing condition, the valve seat member 7 being formed with a downstream opening located at a downstream side of the valve seat member; a first section defining a swirl imparting chamber 46 for imparting a swirl force to fuel within the swirl imparting chamber by turning fuel; a second section defining a fuel injection hole 44 opened to bottom of swirl imparting chamber to inject fuel to outside; and a third section defining a communication passage 45 for connecting the swirl imparting chamber with the opening of the valve seat member. In this fuel injection valve, the swirl imparting chamber 46 and the communication passage 45 are formed to satisfy the following equation:

$$0.15 \leq W/D < 0.5$$

where W is width of the communication passage; and D is diameter of the swirl imparting chamber.

With this configuration, variation of fuel injection characteristics becomes constant relative to change in shape of swirl chamber 41 and fuel injection hole 44, and therefore decision of the specification for fuel injection valve 1 can be easily made. Additionally, variation of the fuel injection characteristics due to production error of swirl chamber 41 and fuel injection hole 44 is small, and therefore error of the fuel injection characteristics can be minimized.

(2) The fuel injection valve 1 comprises: a movable valve element 4; a valve seat member 7 having a valve seat 6 on which the valve element 4 is seated to establish a valve closing condition, the valve seat member 7 being formed with a downstream opening located at a downstream side of the valve seat member; a first section defining a swirl imparting chamber 46 for imparting a swirl force to fuel within the swirl imparting chamber by turning fuel; a second section defining a fuel injection hole 44 opened to bottom of swirl imparting chamber to inject fuel to outside; and a third section defining a communication passage 45 for connecting the swirl imparting chamber with the opening of the valve seat member. In this fuel injection valve 1, the swirl imparting chamber 46 and the communication passage 45 are formed to satisfy the following equation:

$$H/D \geq 0.5$$

where H is height of the communication passage; and D is diameter of the swirl imparting chamber.

With this configuration, variation of fuel injection characteristics becomes constant relative to change in shape of swirl chamber 41 and fuel injection hole 44, and therefore decision of the specification for fuel injection valve 1 can be easily made. Additionally, variation of the fuel injection characteristics due to production error of swirl chamber 41 and fuel injection hole 44 is small, and therefore error of the fuel injection characteristics can be minimized.

(3) The fuel injection valve 1 comprises: a movable valve element 4; a valve seat member 7 having a valve seat 6 on which the valve element 4 is seated to establish a valve closing condition, the valve seat member 7 being formed with a downstream opening located at a downstream side of the valve seat member; a first section defining a swirl imparting chamber 46 for imparting a swirl force to fuel within the swirl imparting chamber by turning fuel; a second section defining a fuel injection hole 44 opened to bottom of swirl imparting chamber to inject fuel to outside; and a third section defining a communication passage 45 for connecting the swirl imparting chamber with the opening of the valve seat member. In this fuel injection valve, the communication passage 45 is formed to satisfy the following equation:

$$0.6 \leq W/H \leq 1.6$$

where W is width of the communication passage; and H is height of the communication passage.

With this configuration, variation of fuel injection characteristics becomes constant relative to change in shape of swirl chamber 41 and fuel injection hole 44, and therefore decision of the specification for fuel injection valve 1 can be easily made. Additionally, variation of the fuel injection characteristics due to production error of swirl chamber 41 and fuel injection hole 44 is small, and therefore error of the fuel injection characteristics can be minimized.

(4) The fuel injection valve 1 comprises: a movable valve element 4; a valve seat member 7 having a valve seat 6 on which the valve element 4 is seated to establish a valve closing condition, the valve seat member 7 being formed with a downstream opening located at a downstream side of the valve seat member; a first section defining a swirl imparting chamber 46 for imparting a swirl force to fuel within the swirl imparting chamber by turning fuel; a second section defining a fuel injection hole 44 opened to bottom of swirl imparting chamber to inject fuel to outside; and a third section defining a communication passage 45 for connecting the swirl imparting chamber with the opening of the valve seat member. In this fuel injection valve, the communication passage 45 and the fuel injection hole 44 are formed to satisfy the following equation:

$$da/d0 \geq 0.5$$

where da is flow equivalent diameter of the communication passage 45; and d0 is diameter of fuel injection hole 44.

With this configuration, variation of fuel injection characteristics becomes constant relative to change in shape of swirl chamber 41 and fuel injection hole 44, and therefore decision of the specification for fuel injection valve 1 can be easily made. Additionally, variation of the fuel injection characteristics due to production error of swirl chamber 41 and fuel injection hole 44 is small, and therefore error of the fuel injection characteristics can be minimized.

(5) By changing the various parameters as discussed in (1) to (4), it is possible to change the mean flow velocity as shown in FIGS. 6 to 9. By this, flow velocity characteristics (fuel moving quantity per unit time) can be changed by changing the mean flow velocity. Additionally, by changing the mean flow velocity, vibrational energy inside liquid and shearing force between liquid and air can be changed thereby changing atomization characteristics of fuel. In general, as flow velocity increases, vibrational energy and shearing force between fuel and air increases thereby promoting atomization of fuel.

<Other Embodiments>

While the present invention has been discussed based on the first embodiment, specific configurations of the fuel injection valve according to the present invention are not limited to those in the first embodiment, so that even various embodiments including design changes and the likes without departing from the spirit and scope of the present invention can be encompassed within the present invention.

<Change in Number of Swirl Chamber>

While three swirl chambers 41 have been shown and described as being formed in fuel injection valve 1 of the first embodiment, it will be understood that the number of swirl chambers 41 may be suitably changed according to design of fuel injection quantity.

Figure 11:
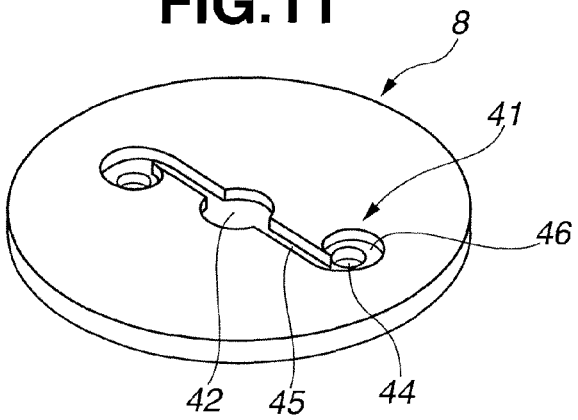
FIG. 11 is a perspective view of another example of the nozzle plate to be used in the first embodiment of the fuel injection valve according to the present invention.

FIG. 11 is a perspective view of another example of nozzle plate 8. As shown in FIG. 11, the nozzle plate 8 may be formed with two swirl chambers 41.

<Change in Shape of Central Chamber>

While central chamber 41 has been shown and described as being formed into the shape of circular depression in fuel injection valve of the first embodiment, it will be understood that the shape of central chamber 14 may be different from that in the first embodiment.

Figure 12:
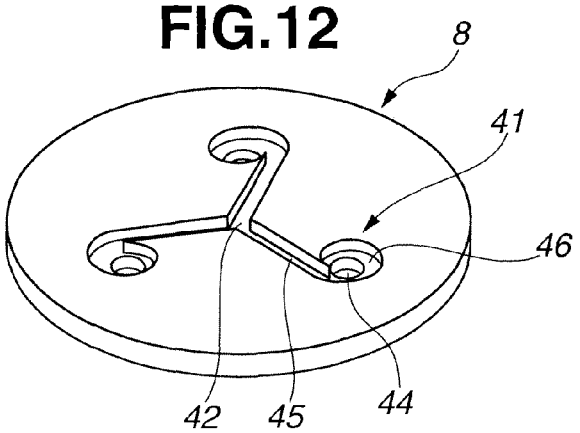
FIG. 12 is a perspective view of a further example of the nozzle plate to be used in the first embodiment of the fuel injection valve according to the present invention.
Figure 13:
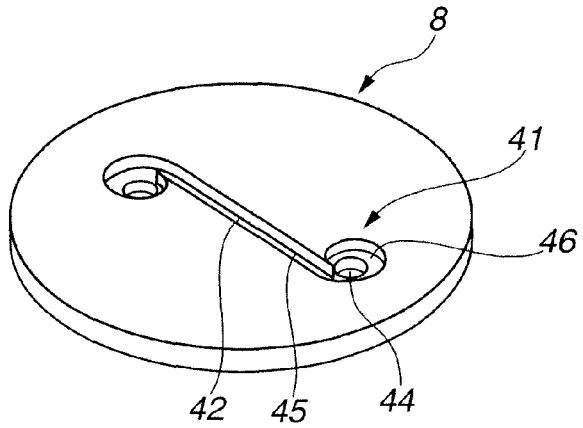
FIG. 13 is a perspective view of a further example of the nozzle plate to be used in the first embodiment of the fuel injection valve according to the present invention.

FIG. 12 is a perspective view of a further example of nozzle plate 8. FIG. 13 is a perspective view of a further example of nozzle plate 8. As shown in FIGS. 12 and 13, all communication passages 45 may be directly connected with each other to form a connected portion which serves as central chamber 42.

<Change in Nozzle Plate>

While nozzle plate 8 has been shown and described as being formed with central chamber 42, swirl chambers 41 and fuel injection hole 44 in the fuel injection valve 1 of the first embodiment, it will be understood that the nozzle plate 8 may not formed with all such chambers and hole.

Figure 14:
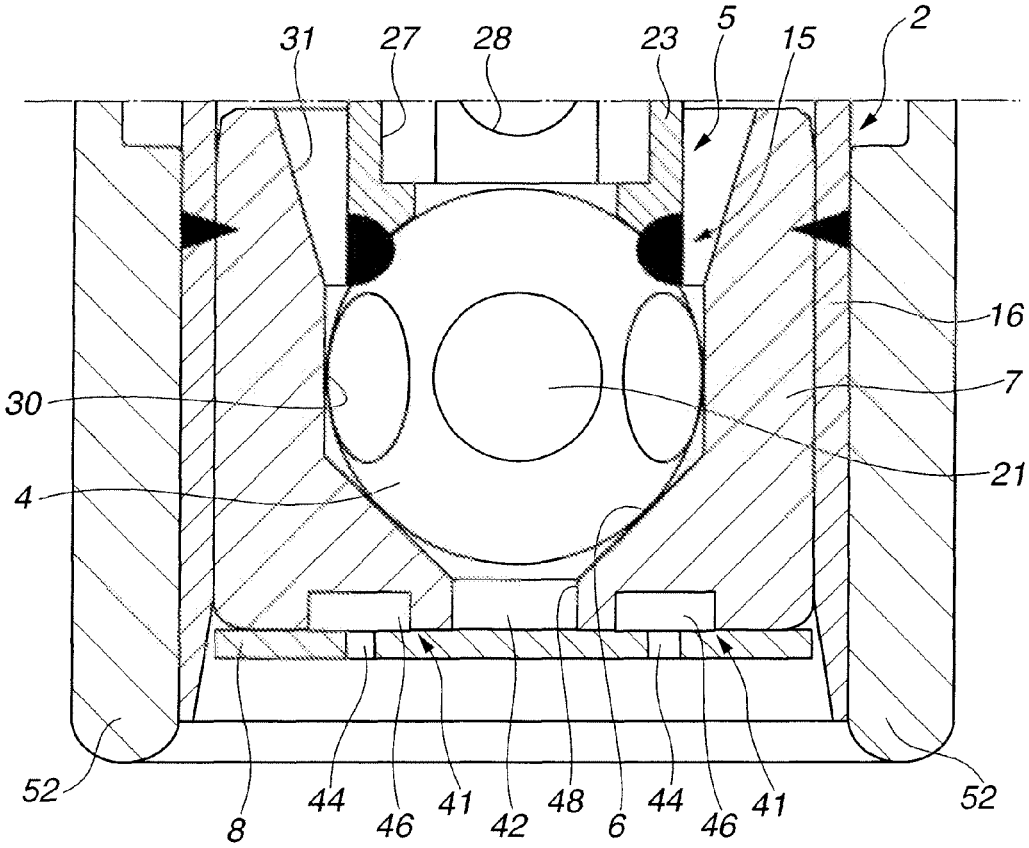
FIG. 14 is an enlarged fragmentary axial sectional view of a section around the nozzle plate, showing a second embodiment of the fuel injection valve according to the present invention.
Figure 15:
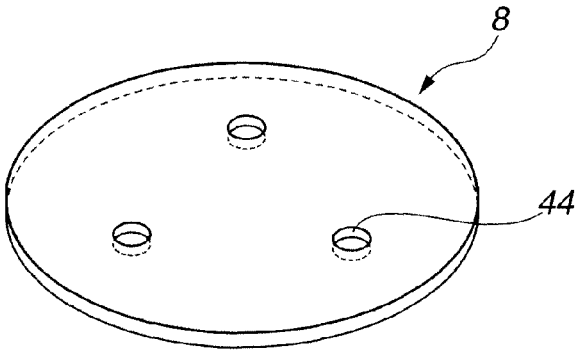
FIG. 15 is a perspective view of the nozzle plate used in the second embodiment of the fuel injection valve.

FIG. 14 is an enlarged axial sectional view of a section around nozzle plate 8 of a second embodiment of fuel injection nozzle 1 according to the present invention. FIG. 15 is a perspective view of a further example of nozzle plate 8. For example, as shown in FIGS. 14 and 15, valve seat member 7 may be formed at its lower end side with central chamber 42 and swirl chambers 41, whereas nozzle plate 8 may be formed with only fuel injection holes 44.

<Addition of Intermediate Plate>

While nozzle plate 8 has been shown and described as being formed with central chamber 42, swirl chambers 41 and fuel injection holes 44 in fuel injection valve 1 of the first embodiment, it will be understood that the nozzle plate 8 may not formed with all such chambers and hole.

Figure 16:
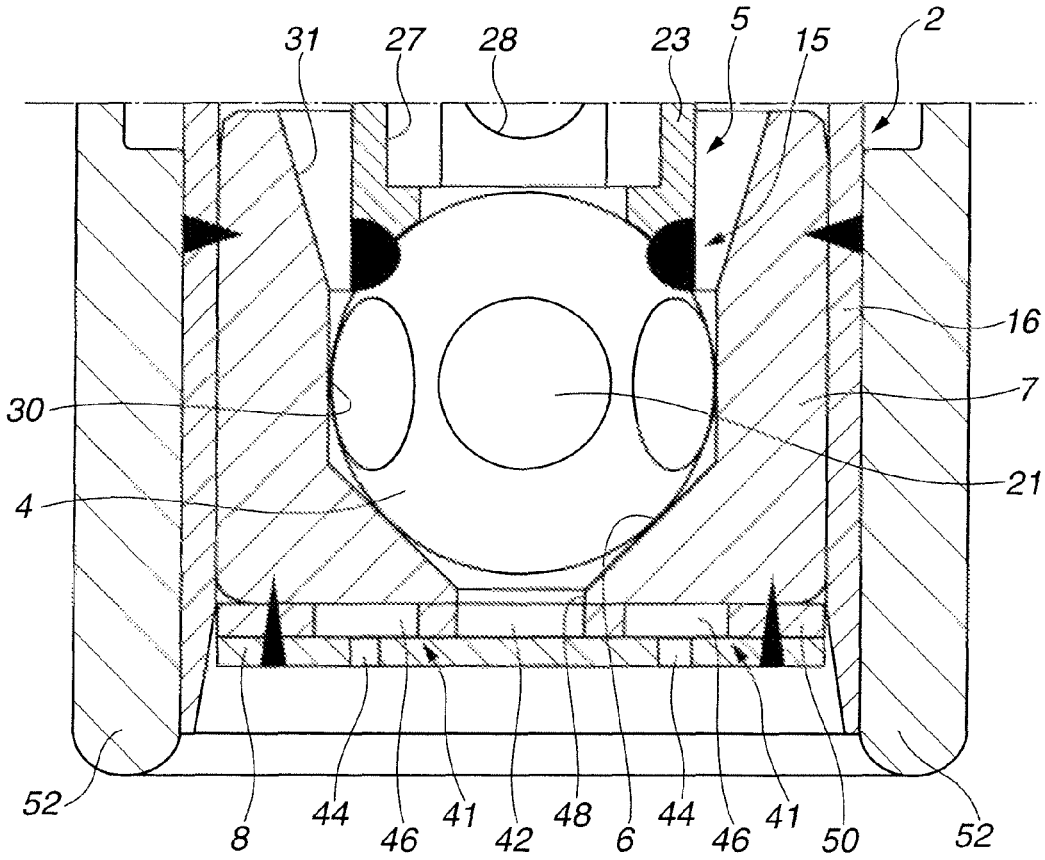
FIG. 16 is an enlarged fragmentary axial sectional view of a section around the nozzle plate, showing a third embodiment of the fuel injection valve according to the present invention.
Figure 17:
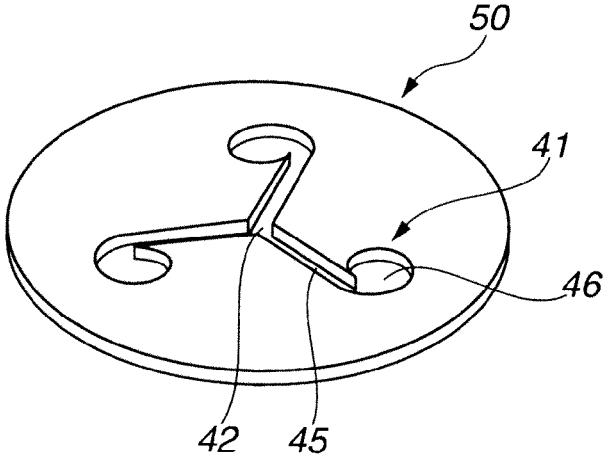
FIG. 17 is a perspective view of an intermediate plate used in the third embodiment of the fuel injection valve.
Figure 18:
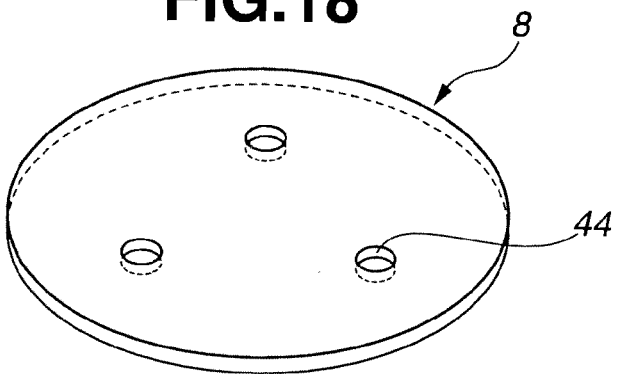
FIG. 18 is a perspective view of the nozzle plate used in the third embodiment of the fuel injection valve.

FIG. 16 is an enlarged sectional view of a section around nozzle plate 8 of a third embodiment of fuel injection valve 1 according to the present invention. FIG. 17 is a perspective view of an intermediate plate 50 used in fuel injection valve 1 shown in FIG. 16. FIG. 18 is a perspective view of nozzle plate 8 used in fuel injection valve 1 shown in FIG. 16. For example, as shown in FIGS. 16 to 18, intermediate plate 50 may be formed with central chamber 42, swirl chambers 41, whereas nozzle plate 8 may be formed with only fuel injection hole 44.

<Change in Swirl Imparting Chamber>

While swirl imparting chamber 46 has been shown and described as being configured to have a spirally formed bottom section as shown in FIGS. 4 and 5 in fuel injection nozzle 1 of the first embodiment, it will be appreciated that swirl imparting chamber 46 may be formed generally circular in plan to impart a swirl force to fuel without using the spirally formed bottom section.

Figure 19:
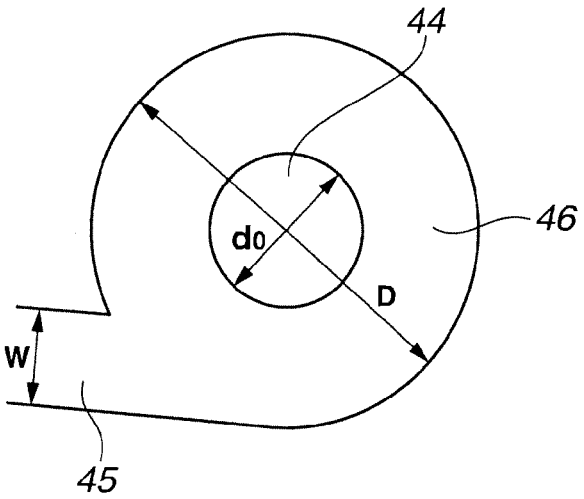
FIG. 19 is a schematic plan view showing the swirl imparting chamber and the fuel injection hole in a further embodiment of the fuel injection valve according to the present invention.
Figure 20:
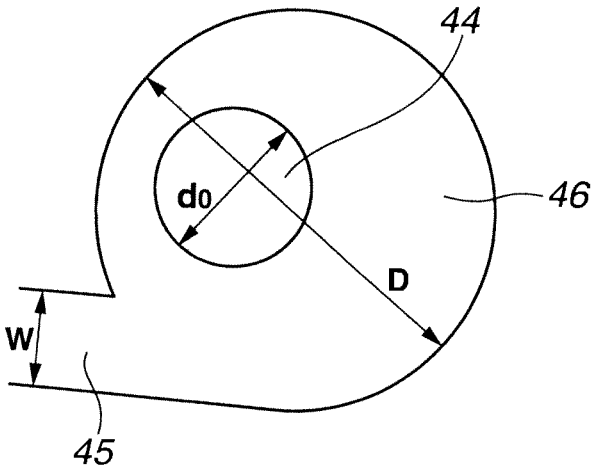
FIG. 20 is a schematic plan view showing the swirl imparting chamber and the fuel injection hole in a further embodiment of the fuel injection valve according to the present invention.

FIGS. 19 and 20 are respectively schematic plan views showing swirl chamber 41 and fuel injection hole 44 in a further embodiment of fuel injection valve 1 according to the present invention. For example, as shown in FIG. 19, swirl imparting chamber 46 may be formed generally perfectly circular in plan. Additionally, as shown in FIG. 20, fuel injection hole 44 may be eccentric to swirl imparting chamber 46 in plan so that the centers of them separate from each other in plan.

<Change in Communication Passage>

While communication passage 45 has been shown and described as being formed as shown in FIG. 5 in fuel injection valve 1 of the first embodiment, it will be appreciated that the configuration of communication passage 45 may be changed as far as it satisfies the relationships of H/D, W/D, W/H and da/d0.

Figure 21:
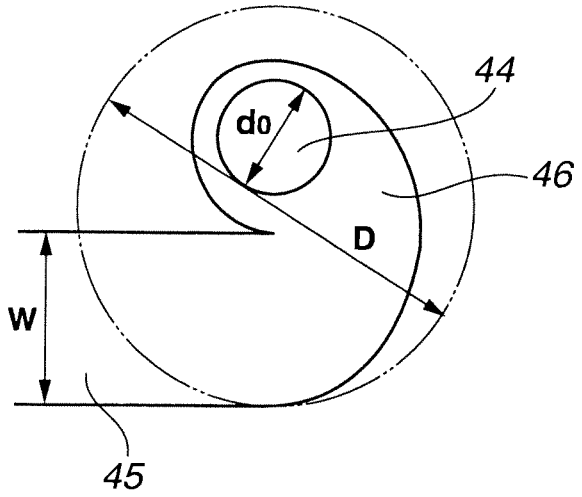
FIG. 21 is a schematic plan view showing the swirl imparting chamber and the fuel injection hole in a further embodiment of the fuel injection valve according to the present invention.

FIG. 21 is a plan view showing swirl chamber 41 and fuel injection hole 44 in a further embodiment of fuel injection valve 1 according to the present invention. For example, as shown in FIG. 21, the width of communication passage 45 may be large as compared with that in the first embodiment.

The entire contents of Japanese Patent Applications P2011-81383, filed Apr. 1, 2011, are incorporated herein by reference.

Although the invention has been described above by reference to certain embodiments and examples of the invention, the invention is not limited to the embodiments and examples described above. Modifications and variations of the embodiments and examples described above will occur to those skilled in the art, in light of the above teachings. The scope of the invention is defined with reference to the following claims.

What is claimed is:

1. A fuel injection valve comprising:

a movable valve element;

a valve seat member having a valve seat on which the valve element is seated to establish a valve closing condition, the valve seat member being formed with an opening located at a downstream side of the valve seat member;

a first section defining a swirl imparting chamber for imparting a swirl force to fuel within the swirl imparting chamber by turning fuel;

a second section defining an injection hole opened to a bottom of the swirl imparting chamber to inject fuel to outside; and a third section defining a communication passage connecting the swirl imparting chamber with the opening of the valve seat member, wherein the swirl imparting chamber and the communication passage are formed to satisfy the following equations:

$$0.15 \leq W/D < 0.5; \text{ and}$$

$$H/D \geq 0.15;$$

wherein W is a width of the communication passage, D is a diameter of the swirl imparting chamber, and H is a height of the communication passage.

2. A fuel injection valve as claimed in claim 1, wherein:

the first section defines two swirl imparting chambers each of which imparts a swirl force within the respective swirl imparting chamber by turning fuel, and the third section defines two communication passages each of which connects a respective swirl imparting chamber with the opening of the valve seat member.

3. A fuel injection valve as claimed in claim 2, wherein the two communication passages are connected to each other to form a central chamber located at a position at which the two communication passages are connected to each other.

4. A fuel injection valve as claimed in claim 1, further comprising a nozzle plate disposed in contact with the valve seat member and including the first, second and third sections so that the swirl imparting chamber, the injection hole and the communication passage are formed in the nozzle plate.

5. A fuel injection valve as claimed in claim 1, further comprising an intermediate plate disposed in contact with the valve seat member and including the first and third sections so that the swirl imparting chamber and the communication passage are formed in the intermediate plate; and a nozzle plate disposed in contact with the intermediate plate and including the second section so that the injection hole is formed in the nozzle plate.

6. A fuel injection valve as claimed in claim 1, wherein the swirl imparting chamber is generally circular in plan.

7. A fuel injection valve as claimed in claim 1, wherein the injection hole is eccentric in plan to the swirl imparting chamber.

8. A fuel injection valve as claimed in claim 1, wherein the communication passage is tangentially connected to the swirl imparting chamber.

9. A fuel injection valve comprising:

a generally cup-shaped valve seat member having a valve seat and formed with an opening located at a downstream side of the valve seat member;

a generally spherical valve element movably disposed to the valve seat member and seated on the valve seat of the valve seat member to establish a valve closing condition;

a generally disc-shaped nozzle plate coaxially disposed to the valve seat member and formed with a plurality of injection holes through which fuel is injected to outside;

a plurality of swirl imparting chambers each structured to impart a swirl force to fuel within the respective swirl imparting chamber by turning fuel, and a section defining a plurality of communication passages each of which connects each swirl imparting chamber with the opening of the valve seat member, each swirl imparting chamber being connected to each injection hole of the nozzle plate, each communication passage having a first end tangentially connected to each swirl imparting chamber, the communication passages having respective second ends which are connected to each other to form a chamber which is connected to the opening of the valve seat member, wherein each swirl imparting chamber and each communication passage are formed to satisfy the following equations:

$$0.15 \leq W/D < 0.5; \text{ and}$$

$$H/D \geq 0.15;$$

wherein W is a width of each communication passage, D is a diameter of each swirl imparting chamber, and H is a height of each communication passage.

10. A fuel injection valve as claimed in claim 9, wherein the swirl imparting chambers and the section defining the communication passages form part of the nozzle plate.

11. A fuel injection valve as claimed in claim 9, wherein the swirl imparting chambers and the section defining the communication passages form part of the valve seat member.

12. A fuel injection valve as claimed in claim 9, wherein the swirl imparting chambers and the section defining the communication passages form part of a generally disc-shaped intermediate plate disposed between the valve seat member and the nozzle plate.

13. A fuel injection valve as claimed in claim 9, wherein each swirl imparting chamber has a bottom portion forming part of the swirl imparting chamber and the section defining the communication passages, the bottom portion having a spiral surface along which fuel moves.

14. A fuel injection valve as claimed in claim 13, wherein each fuel injection hole opens to the spiral surface.

15. A fuel injection valve as claimed in claim 1, wherein the swirl imparting chamber and the communication passage are formed to further satisfy the following equation:

$$0.6 \leq W/H \leq 1.6.$$

16. A fuel injection valve as claimed in claim 15, wherein the swirl imparting chamber and the communication passage are formed to further satisfy the following equation:

$$da/d0 \geq 0.5,$$

wherein da is a flow equivalent diameter of the communication passage, and d0 is a diameter of the fuel injection hole.

17. A fuel injection valve as claimed in claim 9, wherein each swirl imparting chamber and each communication passage are formed to further satisfy the following equation:

$$0.6 \leq W/H \leq 1.6.$$

18. A fuel injection valve as claimed in claim 17, wherein each swirl imparting chamber and each communication passage are formed to further satisfy the following equation:

$$da/d0 \geq 0.5$$

wherein da is a flow equivalent diameter of each communication passage, and d0 is a diameter of each fuel injection hole.

19. A production method for a fuel injection valve, the fuel injection valve comprising a movable valve element, a valve seat member having a valve seat on which the valve element is seated to establish a valve closing condition, the valve seat member being formed with an opening located at a downstream side of the valve seat member, a first section defining a swirl imparting chamber for imparting a swirl force to fuel within the swirl imparting chamber by turning fuel, a second section defining an injection hole opened to a bottom of the swirl imparting chamber to inject fuel to outside, and a third section defining a communication passage connecting the swirl imparting chamber with the opening of the valve seat member, the production method comprising:

determining dimensions of the swirl imparting chamber and the communication passage to satisfy the following equations:

$$0.15 \leq W/D < 0.5; \text{ and}$$

$$H/D \geq 0.15;$$

wherein W is a width of the communication passage, D is a diameter of the swirl imparting chamber, and H is a height of the communication passage, and forming the swirl imparting chamber and the communication passage.

20. A production method as claimed in claim 19, wherein the dimensions of the swirl imparting chamber and the communication passage are determined to further satisfy the following equation:

$$0.6 \leq W/H \leq 1.6$$

21. A production method as claimed in claim 20, wherein the dimensions of the swirl imparting chamber and the communication passage are determined to further satisfy the following equation:

$$da/d0 \geq 0.5$$

where da is a flow equivalent diameter of the communication passage, and d0 is a diameter of the fuel injection hole.

* * * * *